United States Patent [19]

Willson, Jr. et al.

[11] Patent Number: 5,029,871

[45] Date of Patent: Jul. 9, 1991

[54] SEQUENCE BOARD GAME

[76] Inventors: Burt Willson, Jr.; Donna Willson, both of 8321 Farrand Rd., Otisville, Mich. 48463

[21] Appl. No.: 436,718

[22] Filed: Nov. 15, 1989

[51] Int. Cl.[5] ..... A63F 3/00

[52] U.S. Cl. ..... 273/271; 273/269

[58] Field of Search ..... 273/263, 264, 269, 271

[56] References Cited

U.S. PATENT DOCUMENTS

| | | | |
|---|---|---|---|
| 1,558,690 | 10/1925 | McCollom | 273/271 |
| 1,871,247 | 8/1932 | Trost | 273/271 |
| 2,179,471 | 11/1939 | Lee . | |
| 2,214,486 | 9/1940 | Snyder . | |
| 3,618,952 | 11/1971 | Tallarida | 273/269 |
| 3,784,200 | 1/1974 | Hotchkiss . | |
| 4,078,804 | 3/1978 | Coster et al. . | |
| 4,302,015 | 11/1981 | Bowser et al. | 273/271 |
| 4,314,703 | 2/1982 | Grottola . | |
| 4,560,171 | 12/1985 | Anthony | 273/269 |

*Primary Examiner*—Edward M. Coven
*Assistant Examiner*—William M. Pierce
*Attorney, Agent, or Firm*—Jerry T. Kearns

[57] ABSTRACT

A board game includes a rectangular game board divided into four quadrants. Each quadrant is divided into a series of adjacent spaces which form a rectangular grid pattern on the game board. The spaces in each quadrant bear indicia designating two of all but one card of a particular suit of cards in a standard playing card deck. Four corner spaces on the game board are designated as "joker" spaces. In play, two standard playing card decks are shuffled together and are partially distributed evenly among a group of players. Players may be divided into two teams, or may play as individuals. In either case, each team or individual player utilizes a different set of distinct game tokens. An initial player discards a card and covers a matching space on the game board with a token selected from one set of game tokens. The player then draws a card from an undistributed portion of the shuffled cards. Play continues in sequential fashion until an adjacent series of horizontal, diagonal or vertical spaces have been covered by tokens of a particular token set. Preferably, play continues until two series of adjacent spaces have been covered by tokens from a single distinct token set. Particular card denominations are designated as wild cards and allow a discarding player to cover any uncovered game board space or to remove an opposing token from the game board.

2 Claims, 4 Drawing Sheets

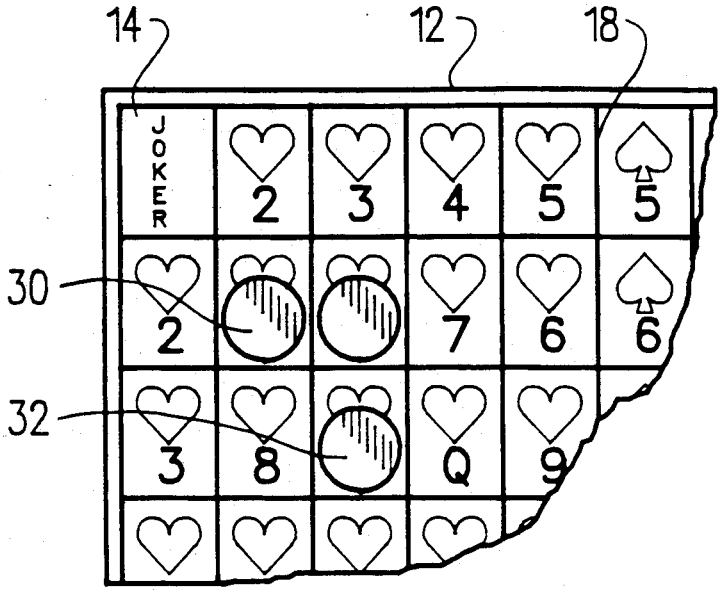
Fig. 2
Fig. 3
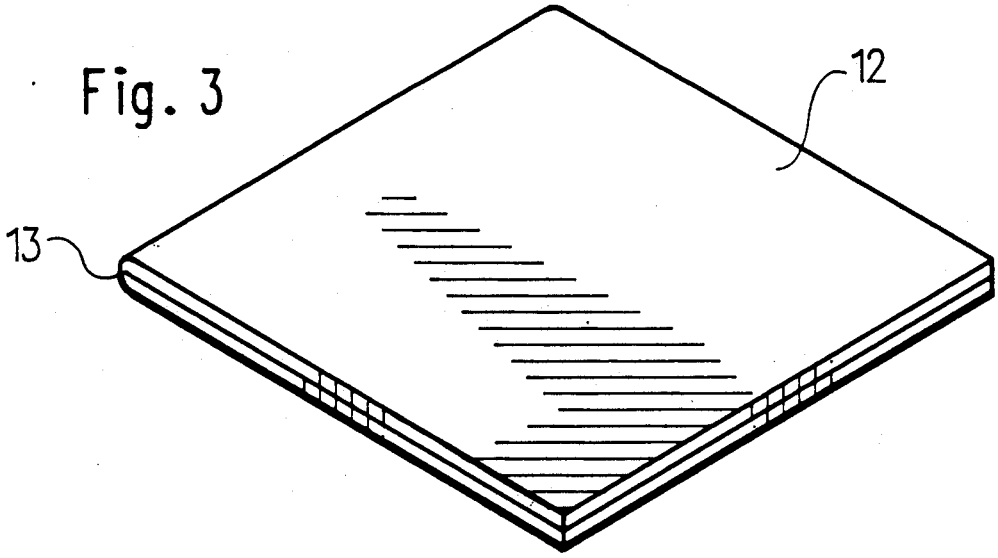
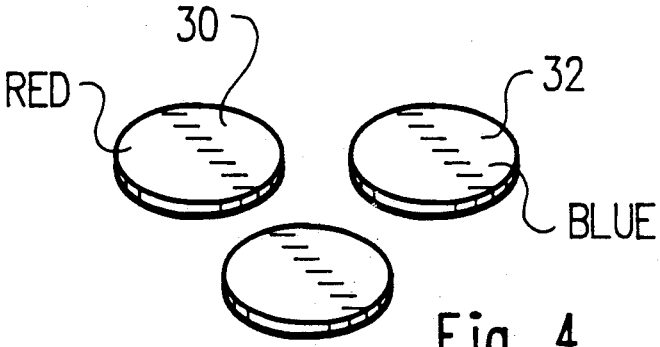
Fig. 4

SEQUENCE BOARD GAME

BACKGROUND OF THE INVENTION

1. Field of the Invention

The present invention relates to board games, and more particularly pertains to an entertaining sequence board game which combines the features of bingo, tic-tac-toe, and standard card games into a single game format.

2. Description of the Prior Art

Various types of board games are known in the prior art. A typical example of such a board game is to be found in U.S Pat. No. 2,179,471, which issued to M. Lee on Nov. 7, 1939. This patent discloses a dart game including a target board having indicia designating standard playing cards. U.S. Pat. No. 2,214,486, which issued to E. Snyder on Sept. 10, 1940, discloses a target board for a dart game divided into a grid pattern formed by a series of adjacent spaces, each of which bear indicia designating various playing card denominations. U.S. Pat. No. 3,784,200, which issued to R. Hotchkiss on Jan. 8, 1974, discloses a tiddly wink type game in which a projectile is flipped onto a game board having a plurality of spaced circular target zones. U.S. Pat. No. 4,078,804, which issued to 0. Coster et al on Mar. 14, 1978, discloses a board game having a game board including a plurality of marked playing stations thereon. A series of station cards are randomly distributed on the playing stations and are utilized to control movement of game markers. U.S. Pat. No. 4,314,703, which issued to 0. Grottola on Feb. 9, 1982, discloses a dart board having a plurality of spaces bearing indicia corresponding to a standard playing card deck.

While the above mentioned devices are directed to board games and include rectangular boards bearing indicia representing standard playing cards, none of these devices disclose a sequence game which combines the features of bingo, tic-tac-toe, and standard playing card games into a single game format. Inasmuch as the art is relatively crowded with respect to these various types of board games, it can be appreciated that there is a continuing need for and interest in improvements to such board games, and in this respect, the present invention addresses this need and interest.

SUMMARY OF THE INVENTION

In view of the foregoing disadvantages inherent in the known types of board games now present in the prior art, the present invention provides an improved sequence board game. As such, the general purpose of the present invention, which will be described subsequently in greater detail, is to provide a new and improved sequence board game which has all the advantages of the prior art board games and none of the disadvantages.

To attain this, representative embodiments of the concepts of the present invention are illustrated in the drawings and make use of a board game which includes a rectangular game board divided into four quadrants. Each quadrant is divided into a series of adjacent spaces which form a rectangular grid pattern on the game board. The spaces in each quadrant bear indicia designating two of all but one card of a particular suit of cards in a standard playing card deck. Four corner spaces on the game board are designated as "joker" spaces. In play, two standard playing card decks are shuffled together and are partially distributed evenly among a group of players. Players may be divided into two teams, or may play as individuals. In either case, each team or individual player utilizes a different set of distinct game tokens. An initial player discards a card and covers a matching space on the game board with a token selected from one set of game tokens. The player then draws a card from an undistributed portion of the shuffled cards. Play continues in sequential fashion until an adjacent series of horizontal, diagonal or vertical spaces have been covered by tokens of a particular token set. Preferably, play continues until two series of adjacent spaces have been covered by tokens from a single distinct token set. Particular card denominations are designated as wild cards and allow a discarding player to cover any uncovered game board space or to remove an opposing token from the game board.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sequence board game which has all the advantages of the prior art board games and none of the disadvantages.

It is another object of the present invention to provide a new and improved sequence board game which may be easily and efficiently manufactured and marketed.

It is a further object of the present invention to provide a new and improved sequence board game which is of a durable and reliable construction.

An even further object of the present invention is to provide a new and improved sequence board game which is susceptible of a low cost of manufacture with regard to both materials and labor, and which accordingly is then susceptible of low prices of sale to the consuming public, thereby making such board games economically available to the buying public.

Still yet another object of the present invention is to provide a new and improved sequence board game which provides in the apparatuses and methods of the prior art some of the advantages thereof, while simultaneously overcoming some of the disadvantages normally associated therewith.

Still another object of the present invention is to provide a new and improved sequence board game which provides an entertaining and fast paced game format.

Yet another object of the present invention is to provide a new and improved sequence board game which combines the features of bingo, tic-tac-toe and standard playing card games into a single game format.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a detail view illustrating the manner of play of the game of the present invention.

FIG. 3 is a perspective view illustrating the game board in a folded storage position.

FIG. 4 is a perspective view illustrating game tokens utilized in the play of the game of the present invention.

DESCRIPTION OF THE PREFERRED EMBODIMENT

Figure 1:
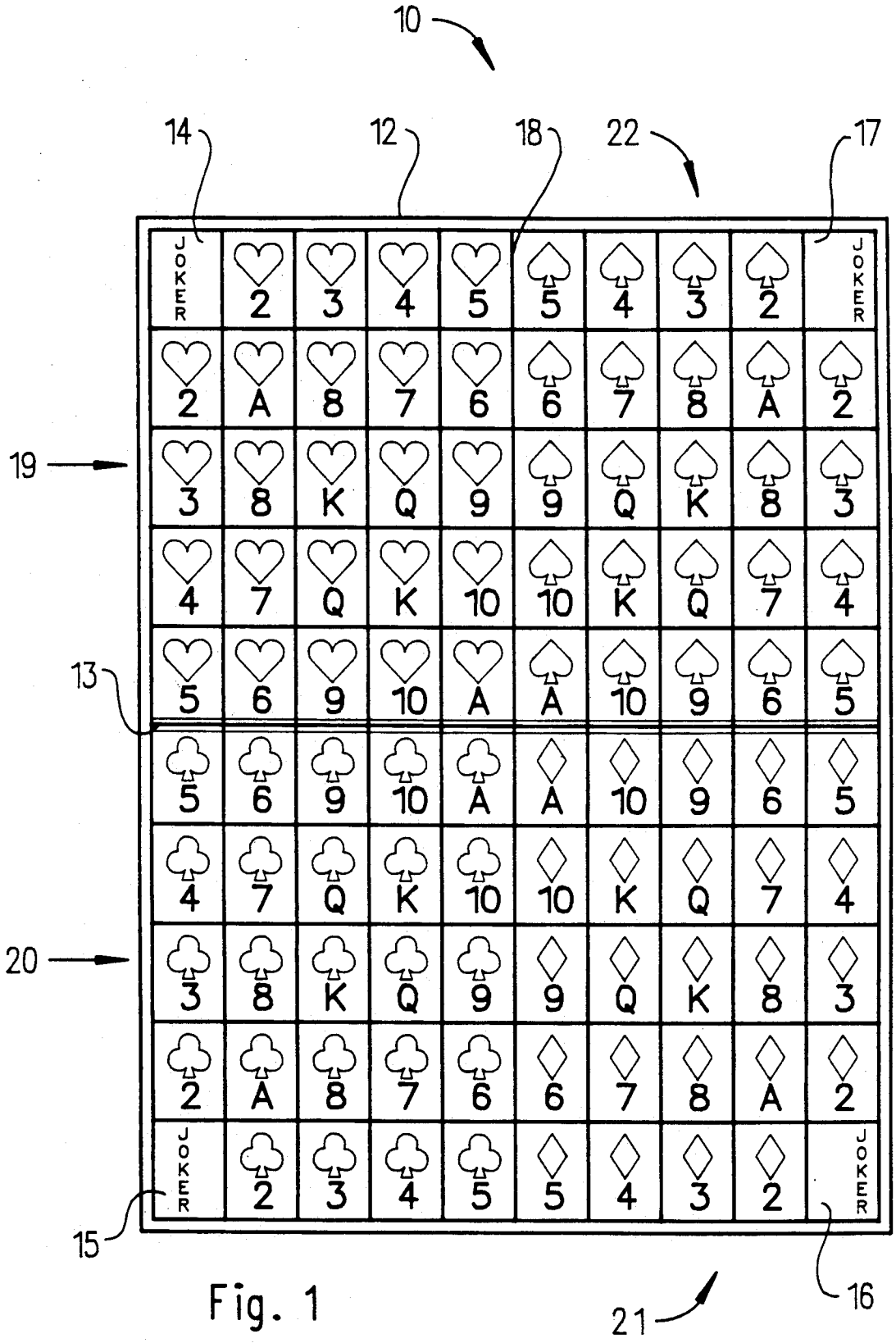
FIG. 1 is a plan view illustrating the game board of the game of the present invention.

With reference now to the drawings, and in particular to FIG. 1 thereof, a new and improved sequence board game embodying the principles and concepts of the present invention and generally designated by the reference numeral 10 will be described.

More specifically, it will be noted that the first embodiment 10 of the invention includes a rectangular game board divided into upper and lower halves by a fold line 13. The horizontal fold line 13 and a central vertical line 18 divide the game board 12 into four quadrants 19, 20, 21 and 22. A corner space 14, 15, 16 and 17 in each of the quadrants 19, 20, 21 and is designated as a "JOKER" space. The remaining spaces in each quadrant bear indicia designating a particular card denomination of a particular suit of a standard 52 playing card deck. It should be noted that each of the quadrants have spaces designating duplicate card denominations in each suit, except for a single card denomination. For example, the zone or quadrant is designated as the "HEART" suit zone or quadrant, and bears duplicate indicia of each card denomination in the 13 card suit, with the exception of the "JACK" card denomination. The quadrant 20 has spaces similarly designated for each card denomination, with the exception of the "JACK" in the "CLUB" suit. The quadrant 21 is designated as the "DIAMOND" suit quadrant or zone, and the quadrant 22 is designated as the "SPADE" zone or quadrant. It should be noted that the indicia on the grid spaces in each quadrant is arranged such that each pair of duplicate spaces fall in a different row and in a different column.

As shown in FIG. 2, a plurality of tokens 30 and 32 are utilized to cover various game board spaces during the course of play.

As shown in FIG. 3, the game board 12 may be folded along the central fold line 13 for storage and transportation purposes.

FIG. 4 illustrates representative tokens 30 and 32 utilized in the course of play. The tokens are divided into two or more distinct token sets, with each set including a plurality of tokens. For example, a first token set may include red tokens 30 and a second token set may include blue tokens 32.

Figure 5:
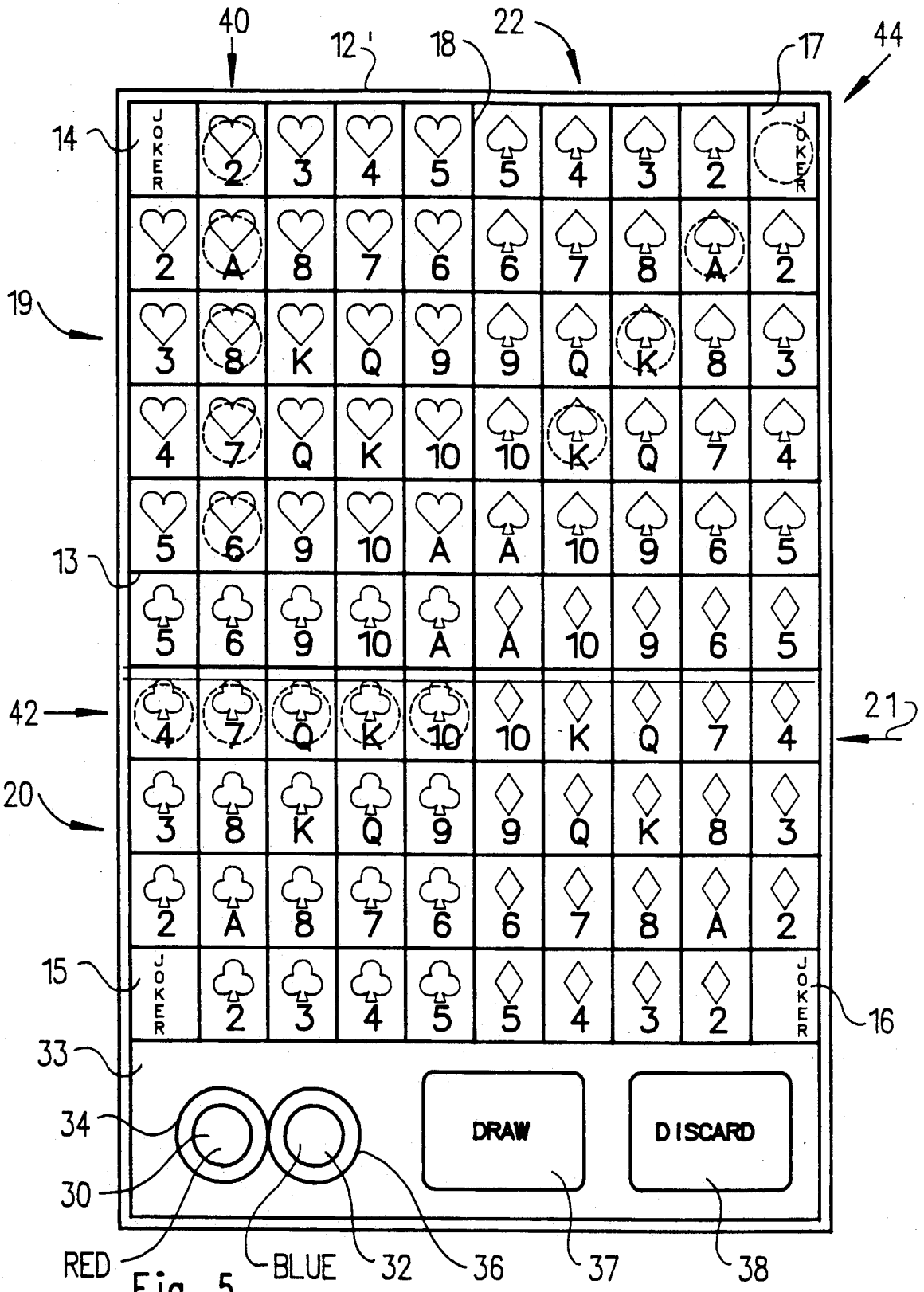
FIG. 5 is a plan view illustrating a slightly modified game board which includes token and card location zones.

FIG. 5 illustrates a slightly modified game board 12', generally similar to the game board 12 shown in FIG. 1. A location zone 33 is formed adjacent a bottom surface of the board 12', and includes token locating indicia circles 34 and 36 which designate storage zones for red tokens 30 and blue tokens 32. A rectangular zone 37 bears indicia designating a location zone for a shuffled card stack and a rectangular zone 38 bears indicia designating a location zone for a discarded card pile.

Figure 6:
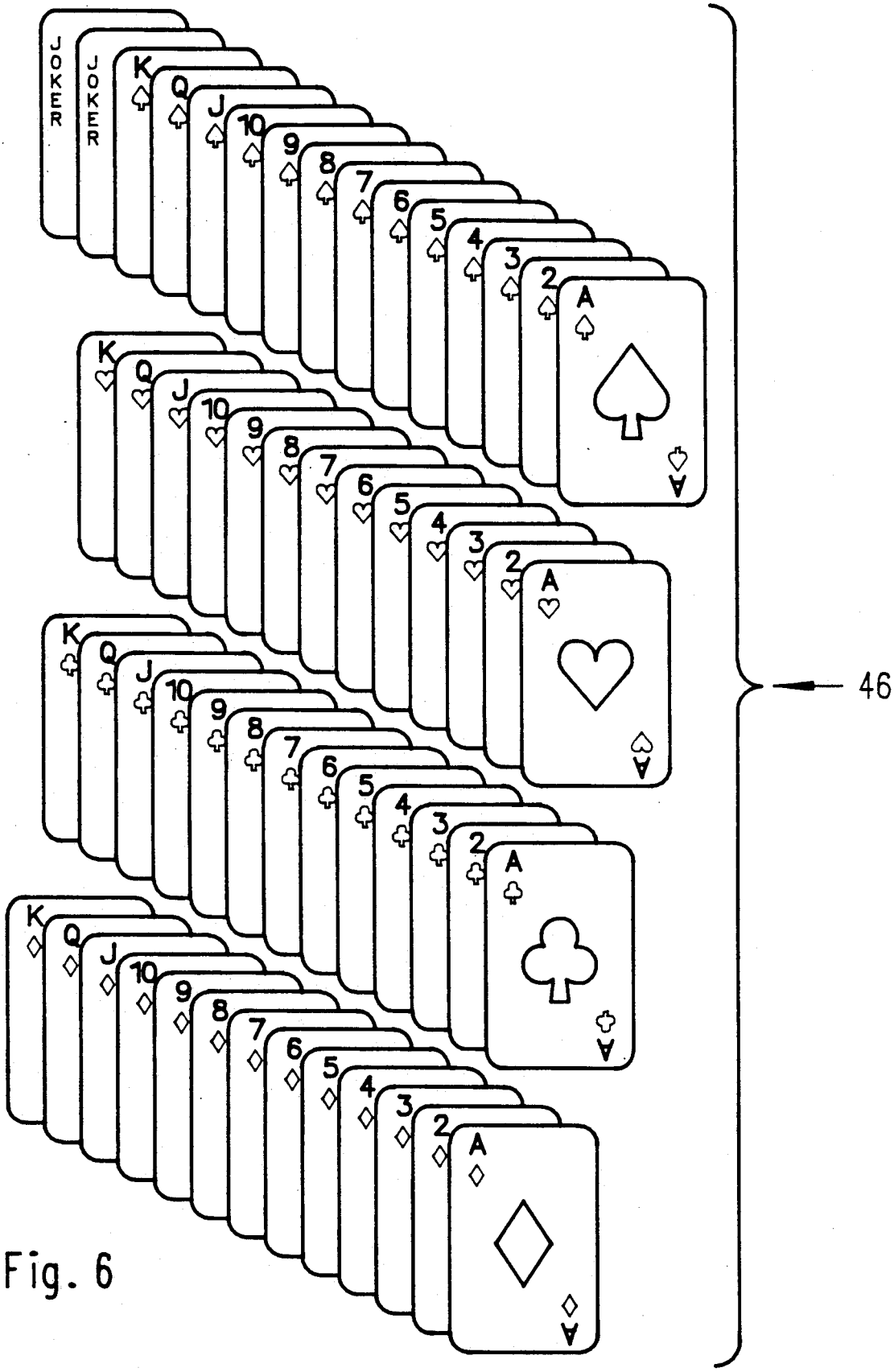
FIG. 6 illustrates a standard playing card deck utilized in the game of the present invention.

FIG. 6 illustrates a standard 52 card deck 46, utilized in the play of the game according to the present invention. With reference now to FIG. 5, the manner of play will now be described. Two standard playing card decks of the type illustrated in FIG. 6 are first combined and shuffled. A portion of the shuffled cards are distributed among a group of players. The group of players may be an even number of players divided into two equal opposing teams. For example, for two or four players, six cards are dealt to each player. With a six player group, five cards are dealt to each player. With an eight player group, four cards are dealt to each player. With a ten player group, three cards are dealt to each player. The remaining shuffled card deck is placed face down in the "DRAW" zone 37 on the board 12'. An initial player selects a single playing card from their hand and places the selected card face up in the "DISCARD" zone 38. The player then selects a token 30 or 32, representing their team color, from the token storage zones 34 or 36. The player then places the selected token on a game board space matching the suit and denomination of the discarded card. The player then draws the top card from the shuffled card stack in the zone 37, and the next adjacent player then continues play in a similar fashion. The "JACK" cards are designated as wild cards. The two "ONE-EYED JACKS" in each of the two standard card decks are wild cards of a first type which allow a discarding player to remove a selected opposing team token from the game board. The two "TWO-EYED JACKS" of each standard card deck are designated as a second type of wild card which allows a discarding player to cover any space on the game board 12' with a selected friendly token 30 or 32. A player discarding either type of wild card "JACK"

continues play on the same turn by drawing another card, but cannot again discard a card. Play continues until any player completes a horizontal, diagonal, or vertical series consisting of a predetermined number of adjacent spaces, all covered by tokens from the same token set. Preferably, the winning team will be declared only upon completing two different adjacent series of spaces, with each series consisting of five adjacent spaces. A special rule of the game includes a provision which allows each of the four corner "JOKER" spaces 14, 15, 16 and 17 to be counted as a covered space when utilized in a series of adjacent spaces. If the two sets of five tokens cross each other, the token at the space of intersection may be counted for both sets of five. Additionally, any established five adjacent covered space series is protected against subsequent wild card removal. Any player having a "DEAD CARD" in their hand may discard it and replace it with a new card at their turn and continue play during the same turn. A "DEAD CARD" is defined as a card suit and denomination of which the two corresponding spaces on the game board 12' have been already been covered. The use of the "WILD CARDS" can create situations in which various particular spaces have been previously covered, leaving the associated playing card denominations unplayable After a token is removed from a space, the space can later be played on again. If any player forgets to draw a card before the next player has taken their turn, the forgetful player must continue play with the reduced card hand. If players talk across the board about the specific course of play, they must each forfeit one card from their hand. Additionally, a larger number of different distinct game token sets may be provided, with each game player utilizing tokens from a different set, and competing as individuals.

As may now be understood, the present invention provides a sequence board game which combines the features of bingo, tic-tac-toe, and conventional playing card games into a single fast paced, exciting and entertaining board game format.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a sequence board game, comprising the steps of:

providing:

a rectangular game board;

said game board divided into four quadrants;

each of said quadrants bearing indicia defining a plurality of spaces, said spaces forming a rectangular grid pattern on said game board;

spaces in each of said quadrants having indicia designating two of all but one card of a particular suit in a standard playing card deck;

four corner spaces on said game board bearing indicia designating a joker of a standard playing card deck;

a plurality of distinct sets of game tokens for covering said spaces;

two standard playing card decks;

combining and shuffling said card decks;

distributing a portion of said card decks evenly among a group of players;

an initial player discarding one of said cards and covering a matching space on said game board with a token selected from one of said distinct sets;

said initial player then drawing a card from an undistributed portion of said shuffled cards;

designating a particular playing card denomination as a wild card, and allowing any player discarding a wild card to remove a selected token from said game board; and continuing play in the above manner in sequential fashion among said group of players until one of said players or a player team completes a horizontal, diagonal or vertical series of a predetermined number of adjacent spaces.

2. The method of playing a sequence board game as recited in claim 1, further comprising the step of continuing play in the previously recited manner until any player or player team completes a first and second series of a predetermined number of adjacent horizontal, diagonal or vertical covered spaces.

* * * * *